United States Patent [19]

English

[11] 4,182,061

[45] Jan. 8, 1980

[54] DISPLAY FRAME

[76] Inventor: J. Richard English, 1168 Oakleigh Dr., East Point, Ga. 30344

[21] Appl. No.: 857,782

[22] Filed: Dec. 5, 1977

[51] Int. Cl.[2] ..... G09F 1/12

[52] U.S. Cl. ..... 40/152.1; 40/10 R; 206/45.34

[58] Field of Search ..... 40/152, 152.1, 156, 40/155, 158 R, 10 D, 10 R; 206/45.34

[56] References Cited

U.S. PATENT DOCUMENTS

| | | | |
|---|---|---|---|
| 1,504,826 | 8/1924 | Larsen | 40/152.1 |
| 1,620,808 | 3/1927 | Eldridge | 40/152.1 |
| 1,954,617 | 4/1934 | Collingbourne | 205/45.34 X |
| 2,072,167 | 3/1937 | Graham | 40/152.1 |
| 3,540,146 | 11/1970 | Watkins | 40/152.1 |
| 3,822,781 | 7/1974 | Braginetz | 206/45.34 X |
| 4,115,938 | 9/1978 | Belmuth et al. | 40/152 |

*Primary Examiner*—John F. Pitrelli

*Attorney, Agent, or Firm*—Jones, Thomas & Askew

[57] ABSTRACT

The display frame includes at least two different display areas within the same frame for exhibiting in one area a two-dimensional object and in another area a three-dimensional object. A special display tray is used to cradle the three-dimensional object so that the object can be exhibited through the display frame.

4 Claims, 5 Drawing Figures

DISPLAY FRAME

BACKGROUND

Picture display frames, for use in exhibiting two-dimensional objects such as photographs, diplomas, certificates and other flat, two-dimensional mementos, are quite commonplace. Likewise, display casings for mounting on walls are very popular for displaying three-dimensional objects such as medals, trophies, books and the like. Sometimes it becomes desirable to display at the same time both a two-dimensional object such as a picture or a diploma and a three-dimensional object such as a medal or tassel which are in some way related. In the past, if two such related but different shaped articles were to be displayed, the two-dimensional picture, etc. might be placed in a frame and the three-dimensional tassel, etc., might be hung from the picture frame or placed on the table surface beside the frame. These solutions are usually impractical or unsightly for a person wishing to display together his personal mementos.

A display frame is needed in which both the two-dimensional and three-dimensional objects can be displayed within a common framework which can be easily moved from place-to-place around the house. Applicant devised an earlier display assembly for a combination two-dimensional and three-dimensional display frame. The applicant's old frame assembly had a front display area which was divided into two viewing sections. Other than the division on the front of the frame, there was no division in display areas between the two-dimensional display area and the three-dimensional display area. The three-dimensional display area in the old frame assembly comprised a groove cut into a backing sheet common to both display areas. The applicant's old frame assembly had the disadvantage that it was difficult to assemble, and one was forced to completely disassemble both the two-dimensional and three-dimensional display areas of the frame assembly when desiring to mount objects in only one of the display areas.

SUMMARY OF THE INVENTION

The present invention is a display frame assembly for mounting within the same frame both a three-dimensional and a two-dimensional object. The present invention differs from the applicant's prior display frame assembly as aforementioned in that the two-dimensional and three-dimensional display areas comprise segregated areas within a common display frame. There is no common backing sheet but rather separate backings in order that the two-dimensional object and three-dimensional object can be separately braced into their respective display areas. In this way, either object can be independently mounted and/or removed without disrupting the other object. A special display tray has been designed as a support and backing piece for the three-dimensional object.

Thus, it is an object of this invention to provide a display frame assembly in which both two-dimensional and three dimensional objects can be simultaneously exhibited.

Another object of this invention is to provide a display frame assembly as previously mentioned in which access to one display area is available without completely disassembling the other display areas.

A further object of this invention is to provide a display frame assembly for exhibiting within the same frame both two-dimensional and three-dimensional objects which can be conveniently hung on the wall, stood up on a table top or otherwise moved around the house as easily as a conventional picture frame.

DETAILED DESCRIPTION

Figure 1:
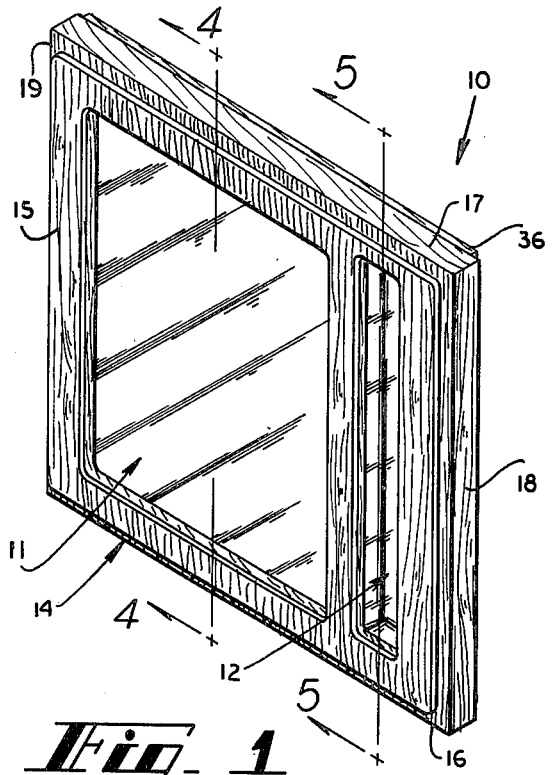
FIG. 1 is a perspective view of the display frame assembly according to the invention.
Figure 2:
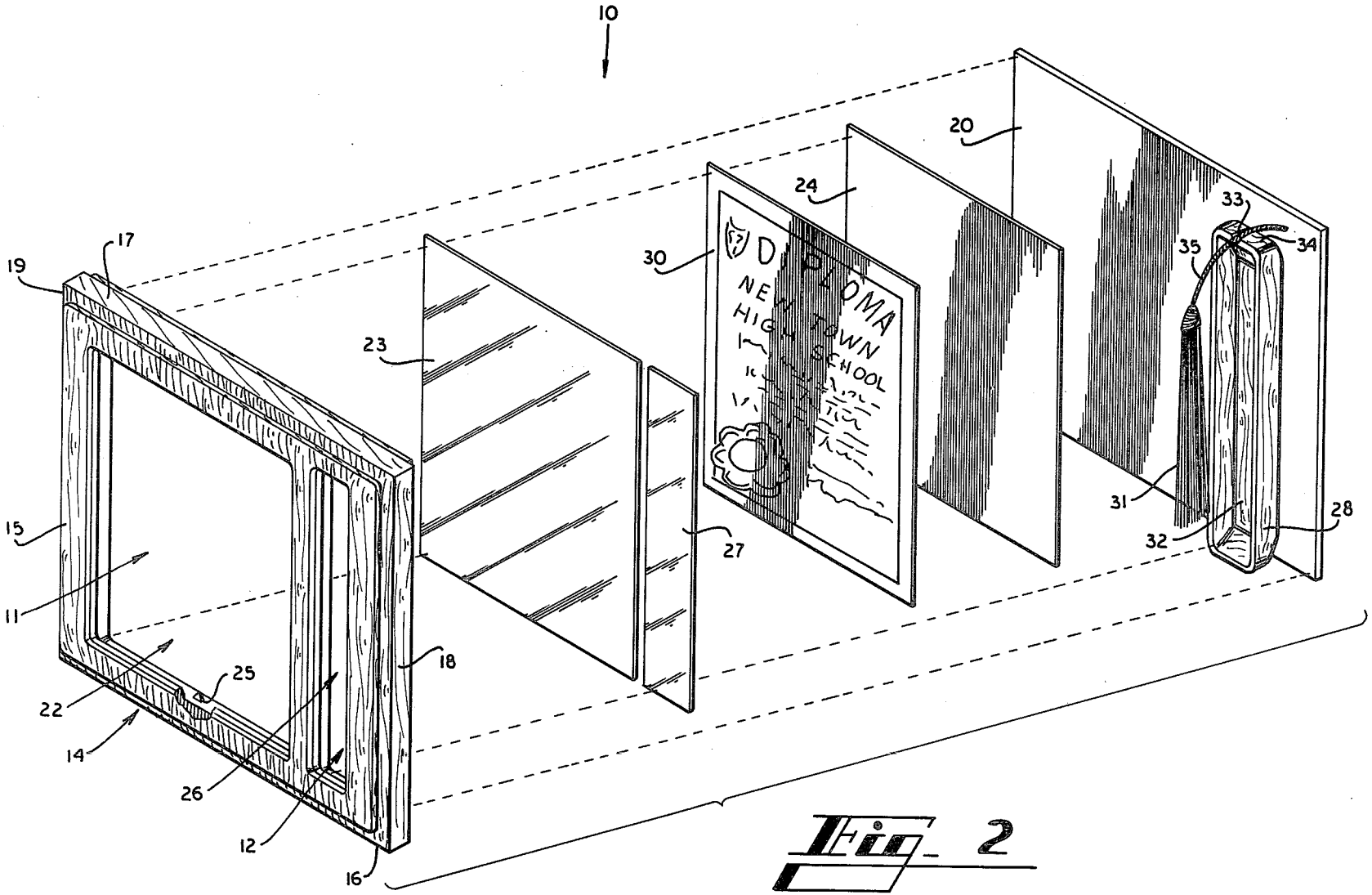
FIG. 2 is an exploded perspective view of the display frame assembly showing the several components of the display frame.

Referring now to the drawings, in which like numbers represent like objects in the different views, FIG. 1 shows the display frame assembly 10 with a display area 11 for two-dimensional objects and a display area 12 for three-dimensional objects. As seen in FIG. 2, both display areas 11, 12 are openings built separately into a common display frame 14. The common display frame 14 comprises the front surface 15 and all four edges 16, 17, 18 and 19 of the common frame 14. There is also a common back support sheet 20 which serves as the back side of the display frame assembly 10.

Inside the invented display frame assembly 10 are found the components of the two separate display areas 11, 12 (see FIG. 2). The two-dimensional display area 11 comprises a window opening 22, a sheet of transparent material 23 and a backing sheet 24. The three-dimensional display area 12 comprises a window opening 26, a piece of transparent sheet material 27 and a display tray 28.

The invented display frame assembly 10 assembles as follows: the transparent sheet 23 for the two-dimensional display area 11 is placed in the window 22 from the back side of the common frame 14; a picture, diploma or other two dimensional object 30 is then placed against the transparent sheet 23 with the design side facing the window; the backing sheet 24 is then placed in position on top of the picture 30 and transparent sheet 23; this backing 24 and the other components 30, 23 are held in place by small tabs 25 which bend around the back side of the backing sheet 24 and hold it in place within the two-dimensional display area 11 (see also FIG. 4). The three-dimensional display area 12 is assembled independently of the two-dimensional display area 11 as follows: the transparent sheet 27 is placed into the window opening 26 from the back side of the common frame 14; the three-dimensional object 31, in this case a graduation tassel, is then placed within the trough-shaped tray area 32 of the display tray 28; the display tray 28, cradling the three-dimensional object 31, is then placed into position behind the transparent sheet 27 with the three dimensional object facing toward the window opening. The back support sheet 20 is then placed onto the common frame 14 thus closing in the entire invented display frame assembly 10.

Figure 4:
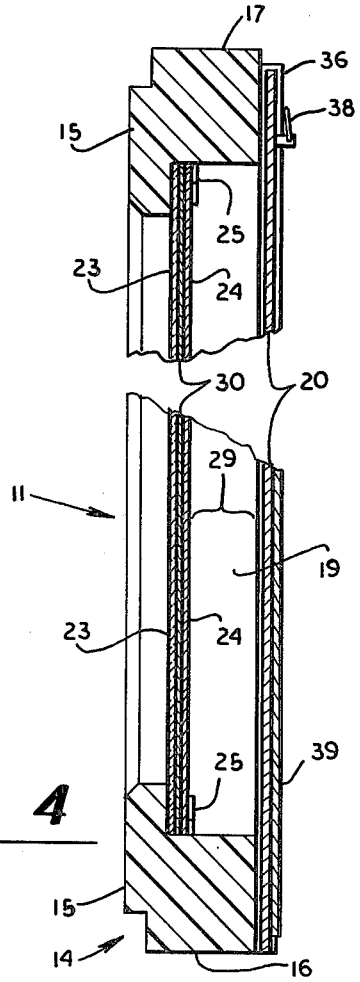
FIG. 4 is a broken cross-sectional side view of the display frame assembly viewed along line 4—4 of FIG. 1.
Figure 5:
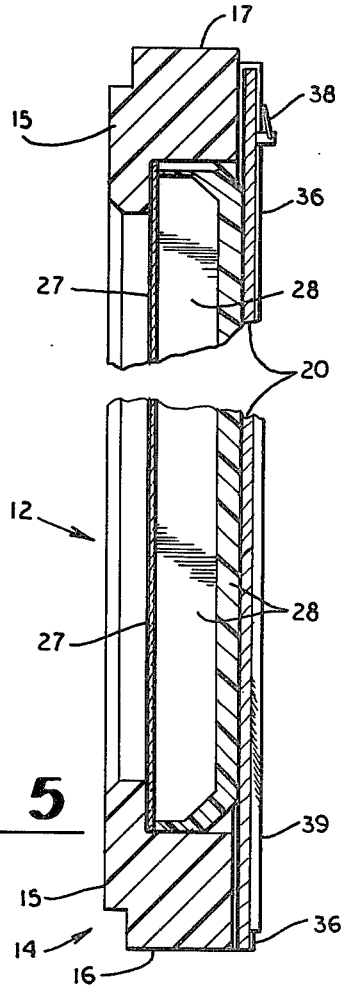
FIG. 5 is a broken cross-sectional side view of the display frame assembly viewed along line 5—5 of FIG. 1.

As seen in FIG. 4, the components 23, 24, 30 of the two-dimensional display area 11 are held close to the front surface 15 of the common frame 14 by the tabs 25 so that the picture or other two-dimensional object 30 is pressed between the transparent sheet 23 and the backing sheet 24. A gap 29 is created between the backing sheet 24 and back support sheet 20 and the back support sheet 20 is, therefore, not a necessary component of the two-dimensional display area 11. Although the back support sheet 20 does not serve any functional purpose with respect to the two-dimensional display area 11, it does serve to press against the back side of the display tray 28 of the three-dimensional display area 12 to hold the display tray 28 in its position against the transparent sheet 27 (see FIG. 5).

There are a few miscellaneous features of the invented display frame assembly 10 which bear mention here. The display tray 28 has a groove 33 cut in its top edge 34 (see FIG. 2). The purpose of this groove is to provide a channel for a piece of rope 35, chain or other like hanging device which is associated with holding the three-dimensional object 31 suspended in position.

Figure 3:
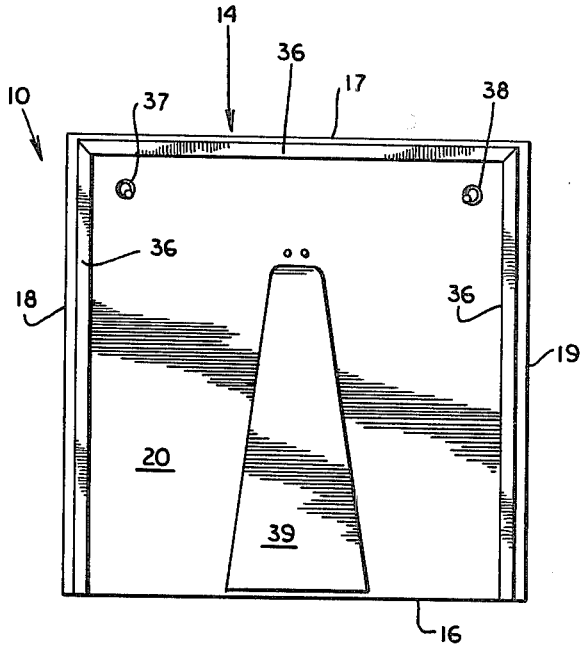
FIG. 3 is a rear view of the display frame assembly.

The back support sheet 20 in the illustrated display frame 10 is attached to the common display frame 15 by a grooved border 36 (see FIG. 3). The grooved border 36 runs along three sides 17, 18, 19 of the back side of the common frame 14 forming three sides of a rectangle with the fourth side, the bottom side 16, having no border 36. The back support sheet 20 is slid into the grooves of the grooved border 36 from the bottom side 16 until it is in position abutting all three portions of the grooved border 36.

Two hanging rings 37 and 38 (see FIG. 3) are attached to the back of the invented display frame assembly 10 on the back support sheet 20 and are used for hanging the invented display frame assembly 10 from the wall or otherwise. An easel back 39 is optionally provided to serve as a stand for proping up the frame 10 on a table top or the like.

While this invention has been described in detail with particular reference to preferred embodiments thereof, it will be understood that variations and modifications can be effected within the spirit and scope of the invention as described hereinbefore and as defined in the appended claims.

I claim:

1. A display frame assembly comprising a frame having a front display surface and a back surface and defining at least two window openings therethrough, transparent sheet material in each window opening, a backing sheet behind said transparent sheet material in one of said window openings, backing sheet retaining means mounted in said frame for maintaining said transparent sheet material and said backing sheet material adjacent the front surface of said frame, a display tray positioned in another one of said windows, said display tray being approximately the same length, width and thickness as its window to substantially fill its window, said display tray defining a concave surface facing the transparent sheet material and forming with said transparent sheet material a space for receiving a three-dimensional object, and a back support sheet removably mounted to the back surface of said frame and confining said transparent sheet material, said backing sheet and said display tray in said frame, whereby a photograph or like two-dimensional object can be placed between said backing sheet and said transparent sheet and a three-dimensional object placed behind said transparent sheet and in the space at the concave surface of said display tray and confined in said frame by said back support sheet for display through said transparent sheet material.

2. Assembly of claim 1 and further including means attached to said back support sheet for use in hanging said display frame from a wall or the like.

3. Assembly of claim 1 and further including an easel back or like means mounted to said back support sheet whereby said display frame can be proped up on a table top or the like.

4. Assembly of claim 1 and wherein said display tray comprises a groove cut in its top edge whereby string or the like can be run through said groove to suspend said three-dimensional object therefrom.

* * * * *